US012624515B2

(12) United States Patent
Lin et al.

(10) Patent No.: US 12,624,515 B2
(45) Date of Patent: May 12, 2026

(54) FLOATING TUNNEL SHORE CONNECTING SYSTEM, FLOATING TUNNEL, AND FLOATING TUNNEL CONSTRUCTION METHOD THEREOF

(71) Applicant: CHINA COMMUNICATIONS CONSTRUCTION COMPANY LIMITED, Beijing (CN)

(72) Inventors: Wei Lin, Beijing (CN); Yinghui Tian, Beijing (CN); Haiqing Yin, Beijing (CN)

(73) Assignee: CHINA COMMUNICATIONS CONSTRUCTION COMPANY LIMITED, Beijing (CN)

( * ) Notice: Subject to any disclaimer, the term of this patent is extended or adjusted under 35 U.S.C. 154(b) by 1029 days.

(21) Appl. No.: 17/748,306

(22) Filed: May 19, 2022

(65) Prior Publication Data

US 2022/0325495 A1 Oct. 13, 2022

Related U.S. Application Data

(63) Continuation of application No. PCT/CN2020/129975, filed on Nov. 19, 2020.

(30) Foreign Application Priority Data

Nov. 19, 2019 (CN) ..... 201911135735.4

(51) Int. Cl.
*E01D 15/14* (2006.01)
*E02D 29/067* (2006.01)

(52) U.S. Cl.
CPC ..... *E02D 29/067* (2013.01); *E01D 15/14* (2013.01); *E02D 2250/00* (2013.01); *E02D 2600/30* (2013.01)

(58) Field of Classification Search
CPC ..... E02D 29/06; E02D 29/063; E02D 29/067; E02D 29/073; E02D 2250/00; E02D 2600/30; E01D 15/14
See application file for complete search history.

(56) References Cited

U.S. PATENT DOCUMENTS 447,735 A * 3/1891 Moeser ..... E02D 29/073 405/135
3,849,821 A * 11/1974 Arild ..... E01D 15/14 14/27

(Continued)

FOREIGN PATENT DOCUMENTS

CN 1570295 A * 1/2005
CN 1590658 A * 3/2005

(Continued)

OTHER PUBLICATIONS

International Search Report and Written Opinion dated Feb. 20, 2021; International Application No. PCT/CN2020/129975; 12 pgs.; ISA/CN, Beijing, China.

*Primary Examiner* — Abigail A Risic
(74) *Attorney, Agent, or Firm* — Central California IP Group, P.C.; Andrew D. Fortney

(57) ABSTRACT

A floating tunnel shore connecting system, a floating tunnel and a floating tunnel construction method are disclosed, where the design method of the floating tunnel is to apply axial tension along one end or two ends of a tube body respectively; The floating tunnel shore connecting system comprises a joint section located at the end of the tube body, which can move along the axial direction and is connected with a tension device for applying axial tension; The floating tunnel comprises a tube body and a hollow cavity, wherein the tube body comprises a floating section and a shore connecting system at two ends, and both joint sections are provided with tension devices. The design method and (Continued)

structure of the floating tunnel provided by the present invention, by applying the axial tension of the tube body, can significantly increase the horizontal stiffness and vertical stiffness of the whole floating tunnel tube body, improving the natural vibration frequency of the tube body, and the safety and reliability of the floating tunnel are improved; It is beneficial to the long-term use of the cable and the foundation anchored on the seabed or the riverbed. The construction risk is also lower, and the cost is also lower, which effectively saves the construction cost, and is easy to implement and popularize the project.

25 Claims, 5 Drawing Sheets

(56) References Cited

U.S. PATENT DOCUMENTS 5,322,390 A * 6/1994 Niimura ..... E02D 29/063 405/134
5,899,635 A * 5/1999 Kuja ..... E02D 29/067 405/134
6,450,734 B1 * 9/2002 Kuja ..... E02D 29/067 405/134
7,942,607 B2 * 5/2011 Bauder ..... E02D 29/067 405/136
2019/0118906 A1 * 4/2019 Grossi ..... B63B 73/49

FOREIGN PATENT DOCUMENTS

| | | | | | |
|---|---|---|---|---|---|
| CN | 201195847 | Y | | 2/2009 | |
| CN | 103556655 | A | | 2/2014 | |
| CN | 206157770 | U | | 5/2017 | |
| CN | 108661081 | A | * | 10/2018 | ..... E02D 29/067 |
| CN | 109653249 | A | | 4/2019 | |
| DE | 2009399 | A1 | | 9/1971 | |
| FR | 2424365 | A1 | * | 4/1978 | |
| GB | 2019926 | A | | 11/1979 | |
| WO | 8909870 | A1 | | 10/1989 | |
| WO | 9743490 | A1 | | 11/1997 | |

* cited by examiner

FLOATING TUNNEL SHORE CONNECTING SYSTEM, FLOATING TUNNEL, AND FLOATING TUNNEL CONSTRUCTION METHOD THEREOF

RELATED APPLICATIONS

The present application is a continuation of International Appl. No. PCT/CN2020/129975, filed Nov. 19, 2020, pending, which claims priority to Chinese Pat. Appl. No. 201911135735.4, filed Nov. 19, 2019, both of which are incorporated herein by reference in their entireties.

FIELD OF THE INVENTION

The present invention relates to the technical field of floating tunnel engineering, particularly a floating tunnel shore connecting system, a floating tunnel thereof, and a floating tunnel construction method.

BACKGROUND TECHNICAL

As a new type of traffic mode across the water area, the floating tunnel in water generally through the combined action of the self-weight and buoyancy of the structure and the anchoring system set on the underwater foundation to maintain the balance and stability of the floating tunnel in water. Because of the complex structure and working environment of the floating tunnel, there is no successful precedent in the world at present, and the technology of the floating tunnel is still in the technical conception and experimental stage.

The technical conception of the existing floating tunnel structure is generally divided into anchor pull type and buoy type. Among them, the structural buoyancy of the anchor-pull floating tunnel tube body is greater than gravity, and the upward floating tube body is anchored on the seabed or river bed through cables; The gravity of the floating tunnel tube is greater than the buoyancy; the sinking tube is "anchored" on the water through the floating pontoon. The cables of the anchor-pull floating tunnel are arranged vertically and obliquely, and the vertical cables only provide vertical restraint to the tube body. The vertical cables provide both vertical and horizontal constraints to the tube body, that is, the stiffness contribution to the floating tunnel structural system includes vertical stiffness contribution and horizontal stiffness contribution. Since the connection between the pontoon and the tube body of the pontoon-type floating tunnel is rigid, the stiffness contribution of the pontoon-type floating tunnel to the structural system of the floating tunnel through the change of its own water buoyancy is only the vertical stiffness contribution.

In addition, the existing technical conception, no matter whether it is anchor-pull floating tunnel or pontoon-type floating tunnel, the two ends of the tube body of two floating tunnels are connected with the shore (that is, the joint of the shore connecting) and both include fixed connection and hinged connection. The way of connecting the shore connecting can restrict the translation and rotation of the end of the tube body by means of fixed connection, and the way of connecting the shore connecting only restricts the translation of the end of the tube body by means of hinged connection. Both types of shore connecting provide the horizontal and vertical stiffness contributions of the floating tunnel structure mainly through the flexural resistance of the tube section. That is to say, it can be predicted that the larger the cross-sectional area of the floating tunnel tube body, the greater the flexural modulus of the tube body section, and the greater the horizontal and vertical stiffness of the floating tunnel structural system.

The inventor found that pontoon type floating tunnel and anchor-pull type floating tunnel exist following technical problem in carrying out this project research:

For the pontoon-type floating tunnel, the pontoon can only provide vertical restraint through the change of hydrostatic buoyancy, but cannot provide the horizontal restraint, i.e., cannot contribute to the horizontal stiffness of the floating tunnel structure system, therefore, the contribution of the pontoon-type floating tunnel horizontal stiffness all comes from the constraints of shore connecting and bending modulus of tube body sections. When the floating tunnel spans a long water area, no matter how large the cross-section of the tube body is, compared to the length of the floating section of the tube body, the overall tube body is a "slender rod" structure, and the horizontal stiffness of the tube body is still relatively high. Therefore, the deflection of the floating tunnel structure is too large under external waves, water currents and other loads, which affects the safety of the structure, and causes the acceleration of the tunnel operation period to be too large (usually should not exceed 0.3-0.5 m/s2), thus affecting the driving safety and passenger comfort.

For the anchor-pull floating tunnel, the existing problems are:

1. As the water depth increases, the anchor cable anchored on the seabed or the riverbed becomes longer and longer, and the restraint effect on the floating tunnel structure system becomes weaker and weaker, and the contribution to the horizontal stiffness of the structural system will also become less and less, and there are also the same problems as the above-mentioned pontoon-type floating tunnel.

2, the floating tunnel is inevitably exposed to the influence of natural waves and currents, and research generally thinks that the vertical movement of the floating tunnel tube body caused thereby will likely lead to the slack and snap of its cables, and the phenomenon is that the cable with initial tension is completely relaxed due to the movement of the floating tunnel tube body, and then suddenly tightens when it recovers. At this moment, the force of the cable may reach several times its initial tension, resulting in a violent shock in the floating tunnel, the cable broken or damaged, which affects the long-term safety of the floating tunnel and increases the workload of operation and maintenance.

For the above two problems, the current technical solution is to set the floating tunnel tube section of the large buoyancy-to-weight ratio or residual buoyancy to ensure that the cable always maintains a large initial tension, thereby avoiding the occurrence of bouncing shock. However, this solution will lead to an increase in the pull-out bearing capacity of the deep-water foundation for the anchor-pull floating tunnel. Since the processing cost of the deep-water foundation is very high, the construction cost of the floating tunnel will be greatly increased, thereby reducing this kind of anchor-pull. The economy of the design method of the floating tunnel, and even the excessive residual buoyancy requirements will make the foundation scheme of the floating tunnel unable to meet the construction requirements.

In addition, the inventor also found that when the horizontal stiffness of these two kinds of floating tunnel structures was weak, its main vibration frequency was low, and it was easy to encounter the natural wave high-energy area, and the resonance risk was large, which seriously affected the safety of the floating tunnel.

SUMMARY OF THE INVENTION

The purpose of the present invention is to overcome the problem that the existing floating tunnel research in the prior art is still in the stage of technical conception and experiment. The scheme conceived for buoy floating tunnel technology has the problem that the horizontal rigidity is still weak, which affects the structural safety, driving safety and passengers' comfortable experience. The horizontal rigidity of the scheme conceived for anchor-pull floating tunnel technology is still weak, and it is also prone to the phenomenon of elastic shock. Two kinds of floating tunnel structures are easy to high risk of transmitting resonance when meet the natural wave high-energy area, which seriously affects the above-mentioned shortcomings of the safety of the floating tunnel. A floating tunnel shore connecting system and its floating tunnel are provided, and a construction method of the floating tunnel is also provided.

In order to achieve the above inventive object, the present invention provides the following technical solutions:

The present invention first provides a design method of a floating tunnel, which applies axial tension along one end or both ends of the tube body of the floating tunnel, respectively.

A floating tunnel design method provided by the present invention, relative to the technical problem that the horizontal rigidity of existing pontoon type floating tunnel is weaker, and in the terms of the technical problems that the horizontal rigidity is still weaker relative to the scheme of the existing anchor-pull floating tunnel technical conception, and the slack and snap phenomenon is prone to occur, the horizontal stiffness and vertical stiffness of the entire tube body of the floating tunnel can be significantly increased by applying axial tension (the axial tension force is applied to the outside along the axial direction of the tube body) to the tube body at one end or both ends of the floating tunnel, which plays as an additional role in restraining the movement of the tube body, thereby increasing the natural vibration frequency of the floating tunnel body, avoiding the high-energy area of the wave spectrum, reducing the deflection and acceleration of the floating tunnel tube body, and increasing the design redundancy, which improves the safety and reliability of the floating tunnel. Due to the increase of the axial tension, the floating tunnel tube body becomes a structural system with high frequency natural vibration, such as a "string", through a faster frequency vibration and combining with the surrounding water of the tube body, it can effectively play a damping effect. So that when the floating tunnel is moved by waves and currents, the high-frequency vibration of the tube body can make the energy consumption faster. This feature means that the total kinetic energy consumption of the structure for the anchor-pull floating tunnel can be more concentrated on the tube body, which can effectively reduce the stress variation on the cable anchored on the seabed or the riverbed, which is beneficial to the long-term use of the cable and the foundation anchored on the seabed or the riverbed. It can effectively save the construction cost and effectively reduce the maintenance difficulty.

In addition, a floating tunnel design method adopted by the present invention, by the method of applying axial tension on both ends of tube body, has the same technical effect as: ① The pontoon type floating tunnel adopts the method of enlarging the cross-section tube body, which can effectively increase the bending rigidity of the tube body; ② The anchor-pull floating tunnel adopts a larger number of deep water cables to improve the horizontal rigidity of the tube body; ③ The anchor-pull floating tunnel improves the residual buoyancy and the requirement for the uplift resistance force of deep water foundation. Compared with the above three design methods ①②③, the method adopted in this invention is not only easier to realize, but also lower in construction risk and cost, and easier to implement and popularize in engineering.

Preferably, the along the floating tunnel can be adopted to apply several oblique forces at each end, and the resultant force of all the oblique forces along the axial component of the floating tunnel is the axial tensile force applied to the end of the floating tunnel, corresponding all the oblique forces along the radial component of the floating tunnel cancel each other out so that the radial resultant force is 0.

By applying several oblique forces at each end of the floating tunnel, the resultant force of the axial component forces of the several oblique forces in the floating tunnel is used as the axial tensile force received by each end of the floating tunnel, which is relatively easier to realize and more operable than applying an axial tensile force at both ends of the floating tunnel, and can increase the vertical stiffness and overall stability of the end of the floating tunnel.

Preferably, the stress points corresponding to each oblique force applied to each end of the floating tunnel tube body are respectively arranged at different positions along the surface length direction of the floating tunnel body.

Each oblique force is set at each position along the axial length direction of the surface of the floating tunnel body, avoiding setting only along the circumferential direction of the same cross section, which can effectively avoid the stress concentration of the floating tunnel tube body, make the stress points at each position at the end of the floating tunnel as uniform as possible, and improve the stability of the stress structure of the floating tunnel.

Preferably, all stress points along the same cross section of the floating tunnel body are symmetrically arranged, and each stress point receives the same oblique force, and the included angle between the oblique force and the axis of the floating tunnel is also the same. It can effectively ensure that the stress points and stress sizes of each end of the floating tunnel tube body at each position are the same, and it is convenient for subsequent adjustment of the oblique force, and it can effectively ensure that all the corresponding oblique forces along the radial component of the floating tunnel cancel each other so that the radial resultant force is 0.

Preferably, the included angle $\alpha$ between all the above oblique forces applied along each end of the floating tunnel tube body 1 and the axis of the floating tunnel is less than 30°, which can ensure that the vertical rigidity of the floating tunnel tube body is larger, and at the same time, the axial component of each oblique force can be larger, and the resultant force of its axial component, that is, the axial tension, is also larger, effectively improving the horizontal rigidity of the floating tunnel.

Preferably, the size of the axial tension can be adjusted. By adjusting the size of the axial tension, it is easier to adjust the natural frequency of the floating tunnel tube body structure in the operation period, that is, the floating tunnel tube body structure can actively adjust its natural frequency to adapt to the working environment, and thus the safety of the floating tunnel can be more guaranteed.

Preferably, the joint sections at both ends of the floating tunnel tube body pass through the shore foundation. The joint sections at both ends of the tube body of the floating tunnel are hollow passages directly passing through the shore foundation. The joint sections are not fixedly connected to the hollow passages of the shore foundation, but only pass through the hollow passages of the shore foundation. The joint sections are respectively fixed on the shore foundation by several cables provided with oblique force on the tube body, thus realizing the fixation of the joint sections of the floating tunnel. It should be noted that the shore foundation of the present invention is sand layer, soil layer, rock layer or concrete layer with certain bearing capacity, or the above-mentioned composite layers of several foundations, which are located on the river bank, lake bank or coast.

Preferably, a circumferential water-stop member may also be provided between each of the joint sections and the shore foundation, and the circumferential water-stop member is sleeved on the joint section.

Further, the circumferential water-stop member is an elastic structural member.

The hollow channel of the shore foundation can be designed to be larger in size than the joint section, so that when the joint sections are installed in the hollow channel of the shore foundation, there is a gap between them. A circumferential water-stop member is arranged at the gap. The circumferential water-stop member connects the tube body and the shore foundation at the same time, and can have a certain elasticity to adapt to a certain axial relative displacement, that is, the circumferential water-stop member still remains watertight after the joint section receives the axial tension.

Preferably, the above-mentioned floating tunnel is the anchor-pull floating tunnel that the floating section is anchored on the riverbed or the seabed, or is the pontoon-type floating tunnel by connected the floating section to the pontoon, or is the composite pontoon-anchor-pull floating tunnel that the floating section is connected to the pontoon and the anchor system at the same time.

The design method of the floating tunnel is suitable for the currently common anchor-pull floating tunnel anchored on the riverbed or the seabed, or for the two floating tunnel design methods in which the floating section is passed through the pontoon type floating tunnel that is connected to the pontoon, or for the floating section. The floating section is connected to the composite pontoon-anchor-pull floating tunnel with the pontoon and the anchor system at the same time.

The present invention also provides a floating tunnel shore connecting system, which includes a joint section located at the end of the floating tunnel, which can move axially along the tube body. The joint section is provided with a tension device, which is used to apply axial tension to the joint section.

A floating tunnel shore connecting system provided by the present invention, relative to the technical problem that the horizontal rigidity of existing pontoon type floating tunnel is weaker, and in the terms of the technical problems that the horizontal rigidity is still weaker relative to the scheme of the existing anchor-pull floating tunnel technical conception, and the shock phenomenon is prone to occur, by using the joint section of the floating tunnel to connect with the tension device, due to this tension device can apply axial tension to the joint section, the joint section can move freely along the axial direction after being subjected to axial tension, which plays as an additional role in restraining the movement of the tube body, thereby increasing the natural vibration frequency of the floating tunnel body, avoiding the high-energy area of the wave spectrum, reducing the deflection and acceleration of the floating tunnel tube body, and increasing the design redundancy, which improves the safety and reliability of the floating tunnel. Due to the increase of the axial tension, the floating tunnel tube body becomes a structural system with high frequency natural vibration, such as a "string", through a faster frequency vibration and combining with the surrounding water of the tube body, it can effectively play a damping effect. So that when the floating tunnel is moved by waves and currents, the high-frequency vibration of the tube body can make the energy consumption faster. This feature means that the total kinetic energy consumption of the structure for the anchor-pull floating tunnel can be more concentrated on the tube body, which can effectively reduce the stress variation on the cable anchored on the seabed or the riverbed, which is beneficial to the long-term use of the cable and the foundation anchored on the seabed or the riverbed. It can effectively save the construction cost and effectively reduce the maintenance difficulty, and is easy to implement and popularize the project.

Preferably, the above-mentioned joint sections pass through the shore foundation and can move axially relative to the shore foundation. The joint section passes through the shore foundation, but is not fixed or hinged connected to the shore foundation. The joint section can move along the axial direction of the tube body relative to the shore foundation, so as to avoid the reaction force provided by the shore foundation to the joint section when the joint section is pulled by the tension device to reduce the influence of the horizontal rigidity of the tension device lifting the tube body.

Preferably, the joint sections at both ends of the tube body of the floating tunnel are hollow passages directly passing through the shore foundation. The joint sections are not fixedly connected to the hollow passages of the shore foundation, but only pass through the hollow passages of the shore foundation. The joint sections are respectively fixed on the shore foundation by several cables provided with oblique force on the tube body, thus realizing the fixation of the joint sections of the floating tunnel. It should be noted that the shore foundation of the present invention is sand layer, soil layer, rock layer or concrete layer with certain bearing capacity, or the above-mentioned composite layers of several foundations, which are located on the river bank, lake bank or coast.

Preferably, the tension device includes several cables, one end of all the cables is arranged along the periphery of the floating tunnel joint section, and the other end is anchored on the periphery of the shore foundation or the fixed structure.

Due to the large volume of the floating tunnel body, it is difficult to provide stable axial tension to the floating tunnel tube body through one or two cables. Therefore, consider that the tension device includes several cables arranged along the periphery of the floating tunnel joint section, which can respectively provide tension to various parts of the floating tunnel joint section along the periphery, and the resultant force of the axial components of the tension provided by all the cables is taken as the axial tension of each end of the floating tunnel. In this way, the tensile force provided by each required cable will be smaller, which makes it easier to realize and operate in practical engineering. Moreover, it can also keep the stability of the floating tunnel when it is impacted by waves and currents in all directions.

Preferably, all cables are arranged along the length direction of the surface of the floating tunnel joint section.

Each cable is arranged at each position along the axial length direction of the surface of the floating tunnel tube body, which can provide oblique force at each position on the surface of the floating tunnel body, so as to avoid the stress concentration of the floating tunnel tube body caused by the cables arranged only along the circumferential direction of the same cross section, so that the stress points at each position at the end of the floating tunnel can be distributed as uniformly as possible, so as to effectively improve the stability of the stress structure of the floating tunnel.

Preferably, all the cables arranged along the same section of the joint section of the floating tunnel have the same included angle with the axis of the floating tunnel and are symmetrically arranged with each other. Therefore, it is easier to adjust the oblique force of each cable, and it is easier to adjust the axial tension of the floating tunnel joint section.

Preferably, the above-mentioned cables are all obliquely connected to the joint section of the floating tunnel, and the included angle $\alpha$ between each cable and the axis of the floating tunnel is less than 30°. Each cable is obliquely connected to the joint section of the floating tunnel, which is easier to realize and more operable than applying axial tension directly along both ends of the floating tunnel, and can also increase the vertical stiffness and overall stability of the end of the floating tunnel.

Preferably, each cable of the tension device is provided with a tension adjusting mechanism, so that the axial tension applied by the tension device on the joint section can be adjusted. By adjusting the tension of each cable, the axial component of the tension of all cables can be adjusted, so as to adjust the axial tension of the joint section, thus realizing the adjustment of the natural frequency of the floating tunnel tube body structure, that is, the floating tunnel tube body structure can actively adjust its natural frequency to adapt to different working conditions, thereby making the floating tunnel more guaranteed.

Preferably, the tension adjusting mechanism set on each of the cables includes an anchor chamber at the end of the cable, and the anchor chamber is provided with an adjuster which can adjust the tension of the cables, and all the shore anchor chambers are arranged on the shore foundation. It is more convenient and reliable to adjust the tension of each cable through the anchor chamber. In addition, the length of the cable can be flexibly adjusted according to the on-site shore foundation, and the material of the cable can be structural members made of steel wire locks, steel tubes, high-strength cables, and the like.

Preferably, each joint section is provided with several mooring lugs for connecting the cables, or other joint section which are convenient for connecting the cables.

Preferably, the end of the cable is anchored in the precast concrete block located in the shore foundation, or in the steel structure located on the shore ground, and the steel structure can have a large tensile strength. Under the action of the axial tensile load at both ends, the floating tunnel tube body can be provided with greater horizontal stiffness.

Preferably, each joint section includes a ring-shaped steel plate layer and a hollow inner cavity arranged in an outer layer, and the mooring lugs and the steel plate layer can be an integral structure.

Preferably, the inner side of the steel plate layer is also provided with a ring-shaped reinforced concrete layer. Under the condition of ensuring the same structural strength, the use of the reinforced concrete layer in the steel plate layer can effectively reduce the construction cost.

Preferably, the reinforced concrete layer is internally provided with several shear members with one end connected to the steel plate layer, and the shear members is used to enhance the connection strength between the concrete layer and the steel plate layer.

Preferably, a ring-shaped rubber layer is also provided between the steel plate layer and the reinforced concrete layer to enhance the anti-collision and energy dissipation effect of the floating tunnel.

Preferably, a fireproof board layer is also provided on the inner side of the reinforced concrete layer to improve the fireproof capability when a fire occurs in the floating tunnel.

Preferably, a watertight steel plate layer is also provided on the inner side of the fireproof board layer, with a thickness of 0.5-3 cm, so as to improve the waterproofing requirements of the tunnel.

The present invention provides a floating tunnel, including a tube body, and the tube body includes a hollow cavity, and the tube body includes a floating section, and both ends of the floating section are respectively connected with the above-mentioned shore connecting system.

This floating tunnel structure can significantly increase the horizontal stiffness and vertical stiffness of the whole floating tunnel tube body by setting the above-mentioned shore connecting system at both ends of the floating section of the tube body, in which the joint section directly passes through the shore foundation, and then provides axial tension to the joint section by means of the tension device on the joint section, thus playing an additional constraint role on the movement of the tube body and improving the natural vibration frequency of the floating tunnel tube body. It can avoid the high-energy area of the sea wave spectrum, reduce the deflection and acceleration of the floating tunnel tube body, and at the same time, because the design redundancy is increased, the safety and reliability of the floating tunnel are improved. Due to the increase of axial tension, the tube body of the floating tunnel becomes a structural system with high frequency self-vibration, such as a "string". Through faster vibration, combined with the water around the tube body, the damping effect can be effectively achieved, so that when the floating tunnel is moved by waves and water currents in all directions, the high frequency vibration of the tube body can make the energy consumption faster. This feature means that the total kinetic energy consumption of the structure for the anchor-pull floating tunnel can be more concentrated on the tube body, which can effectively reduce the stress variation on the cable anchored on the seabed or the riverbed, which is beneficial to the long-term use of the cable and the foundation anchored on the seabed or the riverbed. The construction risk is also lower, and the cost is also lower, which effectively saves the construction cost, effectively reduces the difficulty of maintenance, and is easy to implement and popularize the project.

Preferably, the sizes of the above-mentioned two axial tensions are the same, and the directions of the axial tensions are opposite.

Preferably, the floating section and the two joint sections both include a steel plate layer and a reinforced concrete layer located in the steel plate layer, all the steel plate layers are integral structural members, and all the reinforced concrete layers are integral structural members.

Preferably, the cross-sectional shape of the tube body is round, square, oval or horseshoe, so as to meet the channel requirements adapted in different underwater working conditions.

Preferably, the floating section is formed by splicing several tube bodies. Preferably, the length of the tube body between the two shore foundations is 50-3000 m.

Further preferably, the length of the tube body between the two shore foundations is 200-2000 m. Considering that the axial tension can have big enough influence factors on the horizontal stiffness of the floating tunnel body, the length of the adapted floating tunnel body should not be too long. According to the design requirements, the length of the floating tunnel body between two shore foundations is 50-3000 m, of which 200-2000 m is more preferable. Preferably, the floating section is provided with an anchoring device which can be anchored on the riverbed or seabed, or the floating section is connected with a pontoon device which can float on the water surface.

The present invention also provides a floating tunnel, a tube body with a hollow cavity, the tube body includes a floating section, one end of which is connected to the shore connecting system as described above, and the other end is connected to a pull-stop section fixed on the shore foundation.

Preferably, the pull-stop section includes a radial protrusion arranged at the end of the floating section, and the shore foundation is provided with a groove portion matched with the protrusion.

Preferably, the protrusion is a structural member integrally formed with the floating section.

Preferably, the pull-stop section is a gravity caisson structure connected to the end of the floating section.

Preferably, the gravity caisson structure is a steel or reinforced concrete caisson structure.

Preferably, the pull-stop section is anti-pull anchor connected to the end of the floating section, and all the anti-pull anchor are anchored on the shore foundation.

Preferably, the floating section and the two joint sections both comprise a steel plate layer and a reinforced concrete layer positioned located in the steel plate layer, all the steel plate layers are integral structural members, and all the reinforced concrete layers are integral structural members.

Preferably, the cross-sectional shape of the tube body is round, square, oval or horseshoe, so as to meet the channel requirements adapted in different underwater working conditions.

Preferably, the floating section is formed by splicing several tube bodies.

Preferably, the length of the tube body between the two shore foundations is 50-3000 m.

The present invention also provides a construction method of a floating tunnel, which includes the following construction steps:

Step 1, manufacturing a floating section and two joint sections of a floating tunnel;

Step 2, constructing two through holes of the shore foundation used to match the joint section of the floating tunnel;

Step 3, respectively passing the two joint sections through the through holes of the shore foundation, and connecting them to the shore foundation through the tension device;

Step 4, connecting the two ends of the floating section with the two joint sections, respectively, to form the floating tunnel tube body;

Step 5, installing an anchoring device which can be anchored on the riverbed or seabed on the floating section, or connecting a pontoon device which can float on the water surface to the floating section;

Step 6. apply axial tension to the tension devices on the two joint sections, and apply tension to the anchoring device, after adjusting each tension to meet the stress requirements, finally complete the construction of the floating tunnel.

The construction method of the floating tunnel of the present invention: by firstly connecting two joint sections to the shore foundation by using the tension devices respectively, then splicing them in sections to form the floating section, finally connecting the floating section to the two joint sections respectively, and then adjusting the axial tension of the two tension devices on the tube body to finally form the floating tunnel; the construction method is simple to operate, can effectively reduce the stress variation of the cable anchored on the seabed or riverbed, is beneficial to the long-term use of the cable and the foundation anchored on the seabed or riverbed. The construction risk is lower and the cost is lower. It effectively saves the construction cost, effectively reduces the maintenance difficulty, and is easy to implement and popularize the project.

The present invention also provides a construction method of a floating tunnel, which includes the following construction steps:

Step 1, manufacturing the floating section, the joint section, and the pull-stop section of the floating tunnel;

Step 2, constructing a through hole of the shore foundation for matching the joint section of the floating tunnel;

Step 3, passing the joint section through the through hole of the shore foundation, and connecting to the shore foundation through the tension device;

Step 4, construction is used to cooperate with the floating tunnel pull-stop section, and the pull-stop section is installed on the shore foundation;

Step 5, connecting the two ends of the floating section to the joint section and the pull-stop section, respectively, to form the floating tunnel tube body;

Step 6, install an anchoring device which can anchor on the riverbed or seabed on the floating section, or connect a pontoon device which can float on the water surface on the floating section;

Step 7, apply axial tension to the tension device on the joint section, and apply tension to the anchoring device, after adjusting each tension to meet the stress requirements, finally complete the construction of the floating tunnel.

The construction method of the floating tunnel of the present invention, by manufacturing the floating section of the floating tunnel, a joint section and a pull-stop section, by firstly connecting a joint section to the shore foundation by using a tension device, and at the same time connect the pull-stop section to the shore foundation. Then, after splicing them in sections to form the floating section, the floating section connects the joint section and the pull-stop section respectively to form the whole floating tunnel tube body. The construction method is simple to operate, can effectively reduce the stress variation of the cable anchored on the seabed or riverbed, is beneficial to the long-term use of the cable and the foundation anchored on the seabed or riverbed. The construction risk is lower and the cost is lower. It effectively saves the construction cost, effectively reduces the maintenance difficulty, and is easy to implement and popularize the project.

Compared with the prior art, the beneficial effects of the present invention:

1. A floating tunnel design method adopted by the present invention, by the method of applying axial tension on one end or both ends of tube body respectively, has the same technical effect as: ① The pontoon type floating tunnel adopts the method of enlarging the cross-section tube body, which can effectively increase the bending rigidity of the tube body; ② The anchor-pull floating tunnel adopts a larger number of deep water cables to improve the horizontal rigidity of the tube body; ③ The anchor-pull floating tunnel improves the residual buoyancy and the requirement for the uplift resistance force of deep water foundation. Compared with the above three design methods ①②③, the method adopted in this invention is not only easier to realize, but also lower in construction risk and cost, and easier to implement and popularize in engineering;

2. A floating tunnel shore connecting system provided by the present invention, relative to the technical problem that the horizontal rigidity of existing pontoon type floating tunnel is weaker, and in the terms of the technical problems that the horizontal rigidity is still weaker relative to the scheme of the existing anchor-pull floating tunnel technical conception, and the shock phenomenon is prone to occur, by using the joint section of the floating tunnel to directly pass through the shore foundation, and then relying on the tension device on the joint section to provide axial tension to the joint section, which plays as an additional role in restraining the movement of the tube body, thereby increasing the natural vibration frequency of the floating tunnel body, avoiding the high-energy area of the wave spectrum, reducing the deflection and acceleration of the floating tunnel tube body, and increasing the design redundancy, which improves the safety and reliability of the floating tunnel. Due to the increase of the axial tension, the floating tunnel tube body becomes a structural system with high frequency natural vibration, such as a "string", through a faster frequency vibration and combining with the surrounding water of the tube body, it can effectively play a damping effect. So that when the floating tunnel is moved by waves and currents, the high-frequency vibration of the tube body can make the energy consumption faster. This feature means that the total kinetic energy consumption of the structure for the anchor-pull floating tunnel can be more concentrated on the tube body, which can effectively reduce the stress variation on the cable anchored on the seabed or the riverbed, which is beneficial to the long-term use of the cable and the foundation anchored on the seabed or the riverbed. It can effectively save the construction cost and effectively reduce the maintenance difficulty, and is easy to implement and popularize the project.

3. In the floating tunnel structure of the present invention, the above-mentioned shore connecting system is arranged at both ends of the floating section of the tube body, wherein the joint section directly passes through the shore foundation, and then the joint section is provided with axial direction by the tension device on the joint section, which can significantly increase the horizontal and vertical stiffness of the entire tube body of the floating tunnel which plays as an additional role in restraining the movement of the tube body, thereby increasing the natural vibration frequency of the floating tunnel body, avoiding the high-energy area of the wave spectrum, reducing the deflection and acceleration of the floating tunnel tube body, and increasing the design redundancy, which improves the safety and reliability of the floating tunnel. The floating tunnel structure applies on anchor type floating tunnel, which means that the total kinetic energy consumption of the structure for the anchor-pull floating tunnel can be more concentrated on the tube body, which can effectively reduce the stress variation on the cable anchored on the seabed or the riverbed, which is beneficial to the long-term use of the cable and the foundation anchored on the seabed or the riverbed. It can effectively save the construction cost and effectively reduce the maintenance difficulty, and is easy to implement and popularize the project.

4. The construction method of the floating tunnel of the present invention: by firstly connecting two joint sections to the shore foundation by using the tension devices respectively, then splicing them in sections to form the floating section, finally connecting the floating section to the two joint sections respectively, and then adjusting the axial tension of the two tension devices on the tube body to finally form the floating tunnel; the construction method is simple to operate, can effectively reduce the stress variation of the cable anchored on the seabed or riverbed, is beneficial to the long-term use of the cable and the foundation anchored on the seabed or riverbed. The construction risk is lower and the cost is lower. It effectively saves the construction cost, effectively reduces the maintenance difficulty, and is easy to implement and popularize the project.

5. The construction method of the floating tunnel of the present invention, by manufacturing the floating section of the floating tunnel, a joint section and a pull-stop section, by firstly connecting a joint section to the shore foundation by using a tension device, and at the same time connect the pull-stop section to the shore foundation. Then, after splicing them in sections to form the floating section, the floating section connects the joint section and the pull-stop section respectively to form the whole floating tunnel tube body. The construction method is simple to operate, can effectively reduce the stress variation of the cable anchored on the seabed or riverbed, is beneficial to the long-term use of the cable and the foundation anchored on the seabed or riverbed. The construction risk is lower and the cost is lower. It effectively saves the construction cost, effectively reduces the maintenance difficulty, and is easy to implement and popularize the project.

BRIEF DESCRIPTION OF THE DRAWINGS

FIG. 1A is a schematic diagram of the stiffness system of the existing floating tunnel structure;

FIG. 1B is a schematic diagram of the structural stiffness system of the floating tunnel after the axial tension is increased;

FIG. 1C is a stress effect diagram of the tube body of the floating tunnel after the axial tension is increased;

REFERENCE NUMBERS IN THE DRAWING

101, shore foundation, 1, tube body, 11, floating section, 12, joint section, 13, steel plate layer, 14, reinforced concrete layer, 15, shearing member, 16, rubber layer, 17, pavement layer, 18, inner cavity, 2, tension device, 21, mooring lug, 22, cable, 23, anchor chamber, 3, pull-stop section, 31, protrusion, 32, groove portion.

DETAILED DESCRIPTION OF THE PREFERRED EMBODIMENTS

A further detailed description will be made to the present invention in combination with test cases and specific implementation modes as follows, but it should not be understood that the scope of the above subject of the present application is only limited by the following embodiments, and all technologies realized on the basis of the contents of the present application shall fall within the scope of the present invention.

Embodiment 1

The present embodiment 1 provides a design method for a floating tunnel, wherein axial tension is applied respectively along both ends of the tube body 1 of the floating tunnel. Of course, an axial tensile force can also be applied along one end of the tubular body 1 of the floating tunnel, while the other end only provides a reaction force.

Figure 1A:
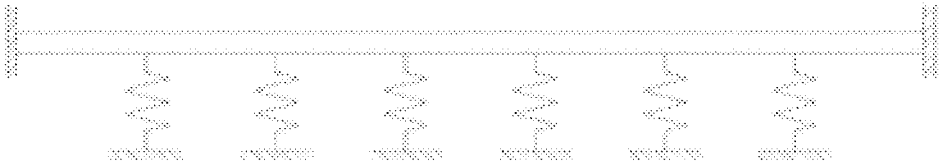
FIGS. 1A-C are schematic diagrams of a design method of a floating tunnel.
Figure 1B:
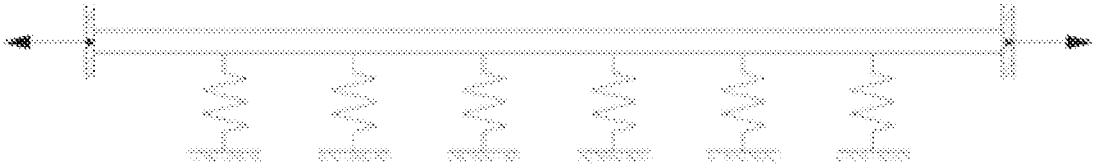
Figure 1C:
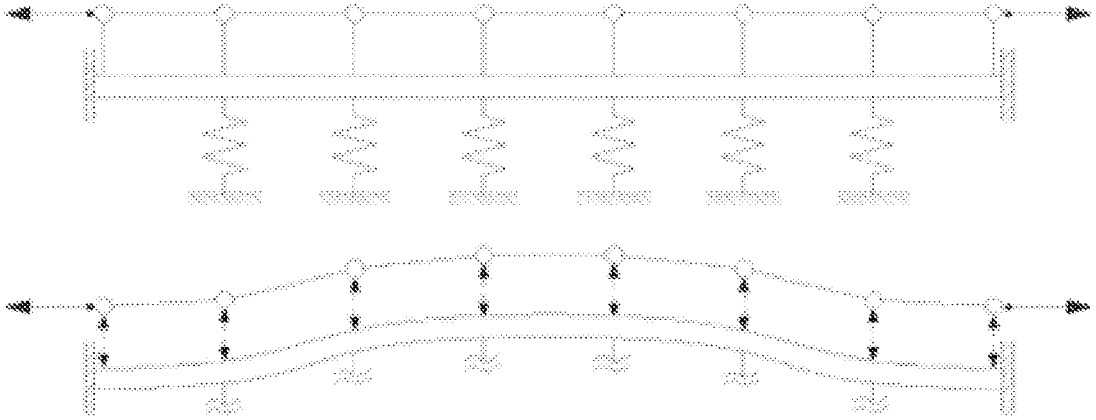

By analyzing the force of the floating tunnel tube body 1, the changes in the front and rear forces when axial tension is applied at both ends of the floating tunnel tube body 1. As shown in FIGS. 1*a*-1*c*, the structural stiffness system of the floating tunnel in the prior art is composed of the stiffness contribution of the tube body 1 and the anchor system (as shown in FIG. 1*a*), and the anchor system can be a cable 22 or a ponton, or can also be a combination of the two. In this embodiment, by applying the axial tension of the tube body 1 (shown in FIG. 1*b*), it additionally increases the stiffness (see FIG. 1*c* for the principle), thereby effectively increasing the natural frequency of the floating tunnel structure.

Illustrate from the mathematical way: the floating tunnel tube body 1 is simplified as the Euler-Bernoulli beam commonly used in engineering, take a micro-section, and the existing floating tunnel tube body 1 movement equation (such as Formula 1) can be written as the right side is the external excitation force, on the left are the four balanced forces, from left to right are the bending force of the tube body 1 (from the bending resistance and anchoring form of the tube body 1), the elastic force (from the anchoring system), and the damping force (mainly from the anchoring system). from the motion of the tube body 1) and inertial forces (mainly from the acceleration of the tube body 1). However, the present invention introduces a new force on the left side of the movement equation, the vertical force of the axial tension (i.e., the vertical force generated by the geometric stiffness caused by the axial tension when the tunnel body 1 moves). Therefore, under the condition of constant external force, in order to maintain the balance of the equation, as the axial tension increases, other forces on the left side of the equation decrease accordingly, which means that the movement and deformation of the tube body 1 decrease. Therefore, it can also be explained from the mathematical formula that with the increase of the axial tension, the movement and deformation of the tube section are restricted. The influence of the axial tension of the tube body 1 on the vibration frequency of the floating tunnel structure can be compared to the tensioned strings of the tube body 1, and expressed by the string formula (Formula 3). It can be seen from the formula that the natural frequency of the strings is only related to the length of the chord (tunnel length) and the quality of the chord (the quality of the tube body 1), which is inversely proportional to the former and inversely proportional to the latter under the sign. When the axial force is increased at the natural frequency of the floating tunnel system in the prior art, the growth relationship of the frequency ($f_{\text{the floating tunnel with the axial force on the tube body}}$) is approximately equal to the sum of the squares of the frequency of the floating tunnel structure without the axial force ($f_{\text{the tube body does not carry the axial force}}$) and the chord frequencies with the axial force is applied ignoring other effects ($f_N$) (as in Equation 4 and FIG. 2).

$$EI\frac{\partial^4\delta(x,t)}{\partial x^4}+k\delta(x,t)+c\frac{\partial\delta(x,t)}{\partial t}+m\frac{\partial^2\delta(x,t)}{\partial t^2}=F(x,t) \quad \text{(Formula 2)}$$

Explanation: Formula 1 is the movement equation of the floating tunnel tube body 1 in the existing design, the left side of the equal sign from left to right is the bending force, elastic force, damping force, inertia force, and the right side of the equal sign is the external excitation force.

$$EI\frac{\partial^4\delta(x,t)}{\partial x^4}+N\frac{\partial^2\delta(x,t)}{\partial x^2}+k\delta(x,t)+c\frac{\partial\delta(x,t)}{\partial t}+m\frac{\partial^2\delta(x,t)}{\partial t^2}=F(x,t) \quad \text{(Formula 2)}$$

Explanation: Formula 2 is the movement equation of the floating tunnel tube body 1 involved in the present invention, and the left side of the equal sign from left to right is the bending force, the vertical force of the axial tension force, the elastic force, the damping force, the inertia force, and the inertial force, the right side of the equal sign is the external excitation force. The new item is the second item—the vertical force of the axial tension.

$$f_N=\frac{1}{2L}\sqrt{\frac{N}{m}} \quad \text{(Formula 3)}$$

The natural frequency of the string, L is length, m is mass, N is the tension $$f^2_{\text{the floating tunnel structure with the axial force on the tube body}}\approx f^2_{\text{the floating tunnel structure without the axial force on the tube body}}+f_N^2 \quad \text{(Formula 4)}$$

The above-mentioned along the floating tunnel can be adopted to apply several oblique forces at each end, and the resultant force of all the oblique forces along the axial component of the floating tunnel is the axial tensile force applied to the end of the floating tunnel, corresponding all the oblique forces along the radial component of the floating tunnel cancel each other out so that the radial resultant force is 0. By applying several oblique forces at each end of the floating tunnel, the resultant force of the axial component forces of the several oblique forces in the floating tunnel is used as the axial tensile force received by each end of the floating tunnel, which is relatively straightforward. Applying an axial tensile force at both ends of the floating tunnel is easier to realize and has more operability, and can increase the vertical stiffness and overall stability of the end of the floating tunnel.

In addition, the stress points corresponding to each oblique force applied to each end of the floating tunnel tube body 1 are respectively arranged at different positions along the surface length direction of the floating tunnel body 1. Each oblique force is set at each position along the axial length direction of the surface of the floating tunnel body 1, avoiding setting only along the circumferential direction of the same cross section, which can effectively avoid the stress concentration of the floating tunnel tube body 1, make the stress points at each position at the end of the floating tunnel as uniform as possible, and improve the stability of the stress structure of the floating tunnel. In particular, all stress points along the same cross section of the floating tunnel body 1 are symmetrically arranged, and each stress point receives the same oblique force, and the included angle between the oblique force and the axis of the floating tunnel is also the same. It can effectively ensure that the stress points and stress sizes of each end of the floating tunnel tube body 1 at each position are the same, and it is convenient for subsequent adjustment of the oblique force, and it can effectively ensure that all the corresponding oblique forces along the radial component of the floating tunnel cancel each other so that the radial resultant force is 0.

Figure 3:
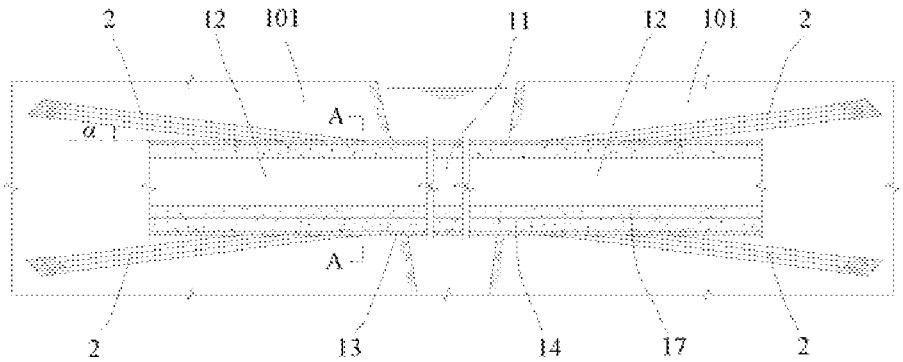
FIG. 3 is a schematic diagram of the first structure of the floating tunnel according to the present invention.

The included angle $\alpha$ (as shown in FIG. 3) between all the above oblique forces applied along each end of the floating tunnel tube body 1 and the axis of the floating tunnel is less than 30°, which can ensure that the vertical rigidity of the floating tunnel tube body 1 is larger, and at the same time, the axial component of each oblique force can be larger, and the resultant force of its axial component, that is, the axial tension, is also larger, effectively improving the horizontal rigidity of the floating tunnel.

In addition, the size of the axial tension can be adjusted. By adjusting the size of the axial tension, it is easier to adjust the natural frequency of the floating tunnel tube body 1 structure in the operation period, that is, the floating tunnel tube body 1 structure can actively adjust its natural frequency to adapt to the working environment, and thus the safety of the floating tunnel can be more guaranteed. The joint sections 12 at both ends of the floating tunnel tube body 1 pass through the shore foundation 101. The joint sections 12 at both ends of the tube body 1 of the floating tunnel are hollow passages directly passing through the shore foundation 101. The joint sections 12 are not fixedly connected to the hollow passages of the shore foundation 101, but only pass through the hollow passages of the shore foundation 101. The joint sections 12 are respectively fixed on the shore foundation 101 by several cables 22 provided with oblique force on the tube body 1, thus realizing the fixation of the joint sections 12 of the floating tunnel. It should be noted that the shore foundation 101 of the present invention is sand layer, soil layer, rock layer or concrete layer with certain bearing capacity, or the above-mentioned composite layers of several foundations, which are located on the river bank, lake bank or coast.

The above-mentioned floating tunnel is the anchor-pull floating tunnel that the floating section 11 is anchored on the riverbed or the seabed, or is the pontoon-type floating tunnel by connected to the pontoon.

The design method of the floating tunnel is suitable for two floating tunnel design methods in which is the currently common anchor-pull floating tunnel anchored on the riverbed or the seabed, or is the pontoon-type floating tunnel by connected the floating section 11 to the pontoon, or the floating section 11 is connected to the composite pontoon-anchor-pull floating tunnel with the pontoon and the anchor system at the same time, and the restraint mode of the floating section 11 can be selected according to the actual situation.

Figure 2:
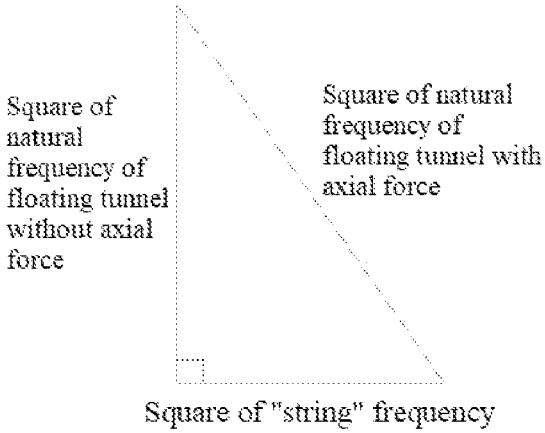
FIG. 2 is a graph showing the relationship between the natural frequency of the floating tunnel without axial tension in the prior art and the natural frequency of the floating tunnel with axial tension in the present invention.

A floating tunnel design method provided by the present invention, relative to the technical problem that the horizontal rigidity of existing pontoon type floating tunnel is weaker, and in the terms of the technical problems that the horizontal rigidity is still weaker relative to the scheme of the existing anchor-pull floating tunnel technical conception, and the shock phenomenon is prone to occur, the horizontal stiffness and vertical stiffness of the entire tube body 1 of the floating tunnel can be significantly increased by applying axial tension to the tube body 1 at both ends of the floating tunnel, which plays as an additional role in restraining the movement of the tube body 1, thereby increasing the natural vibration frequency of the floating tunnel body 1, avoiding the high-energy area of the wave spectrum, reducing the deflection and acceleration of the floating tunnel tube body 1, and increasing the design redundancy, which improves the safety and reliability of the floating tunnel. As shown in FIG. 2, due to the increase of the axial tension, the floating tunnel tube body 1 becomes a structural system with high frequency natural vibration, such as a "string", through a faster frequency vibration and combining with the surrounding water of the tube body 1, it can effectively play a damping effect. So that when the floating tunnel is moved by waves and currents, the high-frequency vibration of the tube body can make the energy consumption faster. This feature means that the total kinetic energy consumption of the structure for the anchor-pull floating tunnel can be more concentrated on the tube body 1, which can effectively reduce the stress variation on the cable 22 anchored on the seabed or the riverbed, which is beneficial to the long-term use of the cable 22 and the foundation anchored on the seabed or the riverbed. It can effectively save the construction cost and effectively reduce the maintenance difficulty.

In addition, a floating tunnel design method adopted by the present invention has the same technical effect as:

① The pontoon type floating tunnel adopts the method of enlarging the cross-section tube body 1, which can effectively increase the bending rigidity of the tube body 1;

② The anchor-pull floating tunnel adopts a larger number of deep water cables 22 to improve the horizontal rigidity of the tube body 1;

③ The anchor-pull floating tunnel improves the residual buoyancy and the requirement for the uplift resistance force of deep water foundation.

Compared with the above three design methods ①②③, the method adopted in this invention is not only easier to realize, but also lower in construction risk and cost, and easier to implement and popularize in engineering.

Embodiment 2

Figure 4:
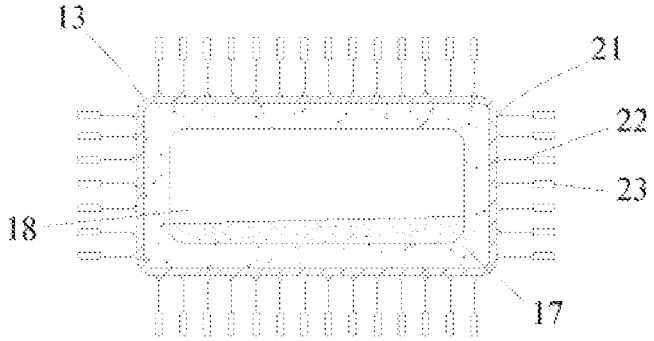
FIG. 4 is a schematic cross-sectional view A-A of the floating tunnel tube body of the first structure of the floating tunnel according to the present invention in FIG. 3.
Figure 5:
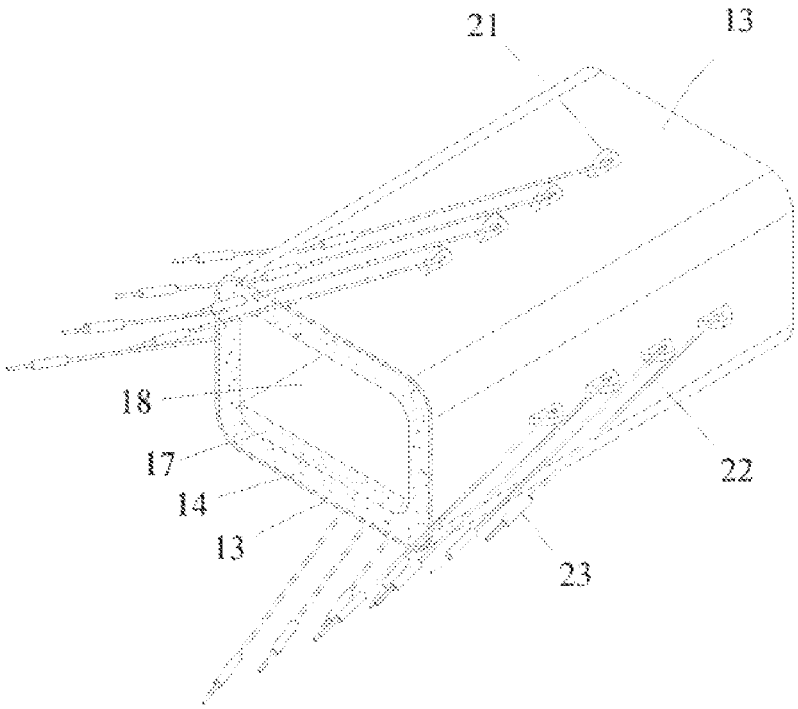
FIG. 5 is an axial side view of the first structure of the floating tunnel in FIG. 3, in which the floating tunnel tube body and the tension device are interconnected.

As shown in FIG. 3-5, Embodiment 2 also provides a floating tunnel shore connecting system, which includes a joint section 12 located at the end of the floating tunnel, which can move axially along the tube body. The joint section 12 is provided with a tension device 2, which is used to apply axial tension to the joint section 12.

Wherein, the above-mentioned joint section 12 passes through the shore foundation 101, but is not fixed or hinged connected to the shore foundation 101. The joint section 12 can move along the axial direction of the tube body 1 relative to the shore foundation 101, so as to avoid the reaction force provided by the shore foundation 101 to the joint section 12 when the joint section 12 is pulled by the tension device 2 to reduce the influence of the horizontal rigidity of the tension device lifting the tube body 1.

The tension device 2 is connected to the shore foundation 101, and by directly connecting the tension device 2 to the shore foundation 101, it is possible to effectively keep the joint section 12 of the floating tunnel tube body 1 relatively fixed with the shore foundation 101. The tension device 2 includes several cables 22 arranged along the periphery of the floating tunnel joint section 12, and each of the cables 22 is anchored to the shore foundation 101 or a fixed structure. Due to the large volume of the floating tunnel body 1, it is difficult to provide stable axial tension to the floating tunnel tube body 1 through one or two cables 22. Therefore, consider that the tension device 2 includes several cables 22 arranged along the periphery of the floating tunnel joint section 12, which can respectively provide tension to various parts of the floating tunnel joint section 12 along the periphery, and the resultant force of the axial components of the tension provided by all the cables 22 is taken as the axial tension of each end of the floating tunnel. In this way, the tensile force provided by each required cable 22 will be smaller, which makes it easier to realize and operate in practical engineering. Moreover, it can also keep the stability of the floating tunnel when it is impacted by waves and currents in all directions. The above-mentioned fixing structure can be a fixed steel structure installed on the shore foundation 101, which can be installed on the ground, on the dam or even below the water surface of the shore foundation 101.

The above-mentioned cables 22 are all obliquely connected to the joint section 12 of the floating tunnel, and the included angle $\alpha$ between each cable 22 and the axis of the floating tunnel is less than 30. Each cable 22 is obliquely connected to the joint section 12 of the floating tunnel, which is easier to realize and more operable than applying axial tension directly along both ends of the floating tunnel, and can also increase the vertical stiffness and overall stability of the end of the floating tunnel. In particular, the tension of each cable 22 of the tension device 2 can be adjusted, so that the axial tension exerted by the tension device 2 on the joint section 12 can be adjusted. By adjusting the tension of each cable 22, the axial component of the tension of all cables 22 can be adjusted, so as to adjust the axial tension of the joint section 12, thus realizing the adjustment of the natural frequency of the floating tunnel tube body 1 structure, that is, the floating tunnel tube body 1 structure can actively adjust its natural frequency to adapt to different working conditions, thereby making the floating tunnel more secure.

All the above-mentioned cables 22 are arranged at different positions along the length direction of the surface of the floating tunnel joint section 12. Each cable 22 is arranged at each position along the axial length direction of the surface of the floating tunnel tube body 1, which can provide oblique force at each position on the surface of the floating tunnel body 1, so as to avoid the stress concentration of the floating tunnel tube body 1 caused by the cables 22 arranged only along the circumferential direction of the same cross section, so that the stress points at each position at the end of the floating tunnel can be distributed as uniformly as possible, so as to effectively improve the stability of the stress structure of the floating tunnel.

In addition, all the cables 22 arranged along the same section of the joint section 12 of the floating tunnel have the same included angle with the axis of the floating tunnel and are symmetrically arranged with each other. Therefore, it is easier to adjust the oblique force of each cable 22, and it is easier to adjust the axial tension of the floating tunnel joint section 12. Each of the cables 22 of the tension device 2 is provided with a tension adjusting mechanism, which includes an anchor chamber 23 connected to the end of each cable 22, each anchor chamber 23 is provided with an adjuster capable of adjusting the tension of the cables 22, and all the shore anchor chambers 23 are arranged on the shore foundation 101. It is more convenient and reliable to adjust the tension of each cable 22 through the anchor chamber 23. In addition, the length of the cable 22 can be flexibly adjusted according to the on-site shore foundation 101, and the material of the cable 22 can be structural members made of steel wire locks, steel tubes, high-strength cables 22 and the like. Each joint section 12 is provided with several mooring lugs 21 for connecting the cables 22.

Figure 6:
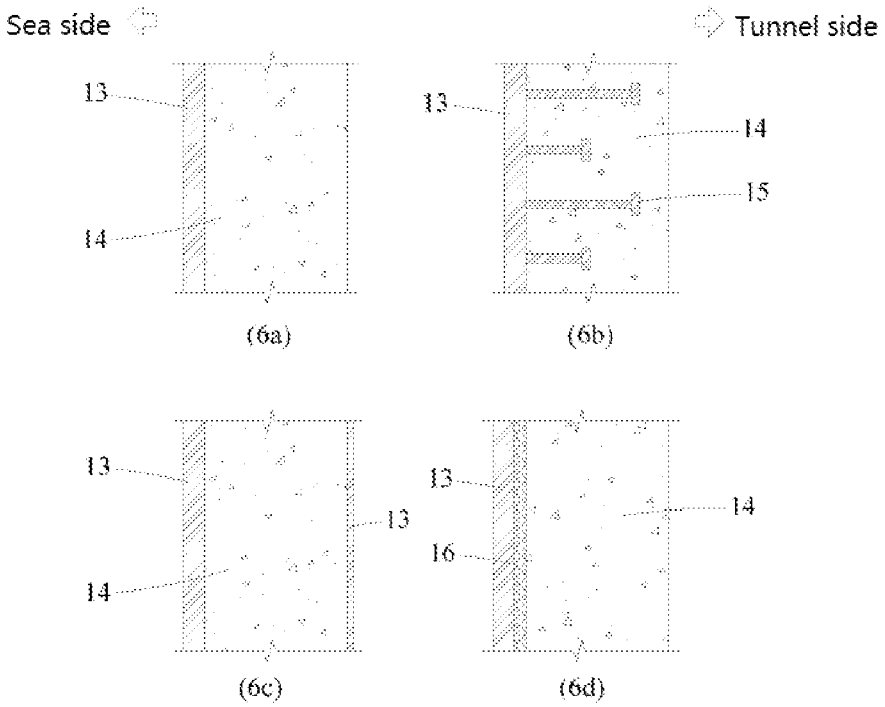
FIG. 6 is four structural design drawings (6*a*-6*d*) of the tube wall section of the floating tunnel body according to the present invention.
Figure 7:
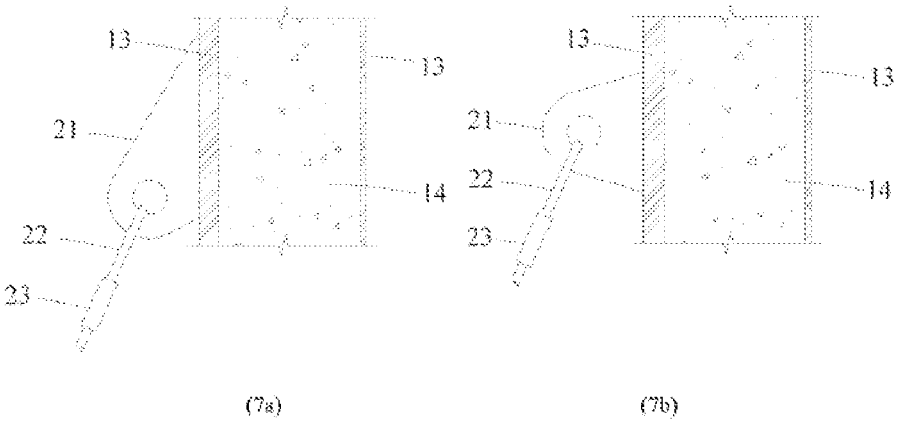
FIG. 7 shows two connection structure diagrams (7*a*, 7*b*) of the tube wall of the floating tunnel body and the tension device according to the present invention.

The end of the cable 22 is anchored in the precast concrete block located in the shore foundation 101, or in the steel structure located on the shore ground, and the steel structure can have a large tensile strength. Under the action of the axial tensile load at both ends, the floating tunnel tube body 1 can be provided with greater horizontal stiffness. The four drawings (6*a*, 6*b*, 6*c*, 6*d*) shown in FIG. 6 are four structural design drawings of the tube wall section, in which, according to the use state of the floating tunnel tube body 1, the layer in contact with the adjacent sea side is the outer layer and the layer in contact with the tunnel side is the inner layer. Each joint section 12 includes a ring-shaped steel plate layer 13 as an outer layer. The tube body 1 has a hollow inner cavity 18 inside, and the pavement layer 17 is laid inside the hollow cavity 18. All the mooring lugs 21 are connected to the steel plate layer 13, and the mooring lugs 21 and the steel plate layer 13 can be an integral structure, wherein the mooring lugs 21 can be standard symmetrical lugs (as shown in FIG. 7*a*), it can also be a special-shaped lug plate in the direction of the oblique tension device (as shown in FIG. 7*b*), and the thickness of the steel plate layer 13 can be selected to be 5-15 cm to meet the horizontal stiffness change requirements of the axial tension of the floating tunnel. The inner side of the steel plate layer 13 is also provided with a ring-shaped reinforced concrete layer 14 (as shown in FIG. 6*a*). Under the condition of ensuring the same structural strength, the use of the reinforced concrete layer 14 in the steel plate layer 13 can effectively reduce the construction cost. The thickness of the reinforced concrete layer 14 is chosen to be 60-195 cm. The reinforced concrete layer 14 is internally provided with several shear members 15 (as shown in FIG. 6*b*) with one end connected to the steel plate layer 13, and the shear members 15 adopt studs or steel members to enhance the connection strength between the concrete layer and the steel plate layer 13. A ring-shaped rubber layer 16 (as shown in FIG. 6*d*) is also provided between the steel plate layer 13 and the reinforced concrete layer 14 to enhance the anti-collision and energy dissipation effect of the floating tunnel. A fireproof board layer is also provided on the inner side of the reinforced concrete layer 14 to improve the fireproof capability when a fire occurs in the floating tunnel. A watertight steel plate layer 13 (as shown in FIG. 6*c*) is also provided on the inner side of the fireproof board layer, with a thickness of 0.5-3 cm, so as to improve the waterproofing requirements of the tunnel.

A floating tunnel shore connecting system described in Embodiment 2, relative to the technical problem that the horizontal rigidity of existing pontoon type floating tunnel is weaker, and in the terms of the technical problems that the horizontal rigidity is still weaker relative to the scheme of the existing anchor-pull floating tunnel technical conception, and the shock phenomenon is prone to occur, the joint section 12 of the floating tunnel directly passes through the shore foundation 101, and then relies on the tension device 2 on the joint section 12 to provide axial tension to the joint section 12, which can significantly increase the horizontal stiffness and vertical stiffness of the entire tube body 1 of the floating tunnel, and play an additional constraint on the movement of the tube body 1, thereby increasing the natural vibration frequency of the tube body 1 of the floating tunnel, avoiding the high energy area of the wave spectrum, The deflection and acceleration of the tubular body 1 of the floating tunnel can be reduced, and the safety and reliability of the floating tunnel can be improved because the design redundancy is also increased. Due to the increase of the axial tension, the floating tunnel tube body 1 becomes a high-frequency natural vibration structure system, such as a "string", through a faster frequency vibration and combining with the surrounding water of the tube body 1, it can effectively play a damping effect. So that when the floating tunnel is moved by waves and currents, the high-frequency vibration of the tube body can make the energy consumption faster. This feature means that the total kinetic energy consumption of the structure for the anchor-pull floating tunnel can be more concentrated on the tube body 1, which can effectively reduce the stress variation on the cable 22 anchored on the seabed or the riverbed, which is beneficial to the long-term use of the cable 22 and the foundation anchored on the seabed or the riverbed. The construction risk is also lower, and the cost is also lower, which can effectively save the construction cost and effectively reduce the maintenance difficulty.

It should be noted that, the tube body 1 of the above-mentioned joint sections 12 are matched with the hollow channel of the shore foundation 101 each other, and both are set to low friction to reduce the loss of axial tension. In addition, a circumferential water-stop member may also be provided between each of the joint sections 12 and the shore foundation 101, and the circumferential water-stop member is sleeved on the joint section 12. Further, the circumferential water-stop member is an elastic structural member. The hollow channel of the shore foundation 101 can be designed to be larger in size than the joint section 12, so that when the joint sections 12 are installed in the hollow channel of the shore foundation 101, there is a gap between them. A circumferential water-stop member is arranged at the gap. The circumferential water-stop member connects the tube body 1 and the shore foundation 101 at the same time, and can have a certain elasticity to adapt to a certain axial relative displacement, that is, the circumferential water-stop member still remains watertight after the joint section 12 receives the axial tension.

Embodiment 3

As shown in FIG. 3-5, Embodiment 3 provides a floating tunnel, which includes a tube body 1 and a hollow cavity 18. The tube body 1 includes a floating section 11, and both ends of the floating section 11 are respectively connected with the shore connecting system as in Embodiment 2 above; The joint sections 12 all pass through the shore foundation 101, and the two joint sections 12 are provided with tension devices 2, which are used to apply axial tension to the corresponding joint sections 12.

Figure 9:
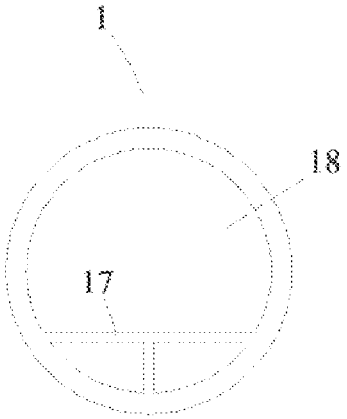
FIG. 9 is a circular cross-sectional shape diagram of the tube body of the floating tunnel according to the present invention.
Figure 10:
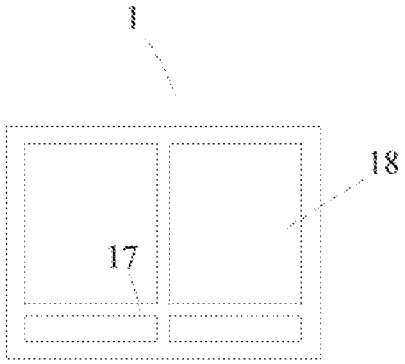
FIG. 10 is a square cross-sectional shape diagram of the floating tunnel tube body according to the present invention.
Figure 11:
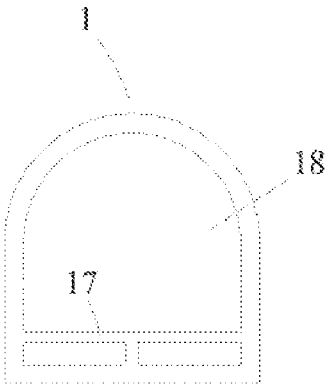
FIG. 11 is a horseshoe-shaped cross-sectional shape diagram of the floating tunnel tube body according to the present invention.

Wherein, the sizes of the above-mentioned two axial tensions are the same, and the directions of the axial tensions are opposite. The floating section 11 and the two joint sections 12 both include a steel plate layer 13 and a reinforced concrete layer 14 located in the steel plate layer 13, all the steel plate layers 13 are integral structural members, and all the reinforced concrete layers 14 are integral structural members. The cross-sectional shape of the tube body 1 is round (as shown in FIG. 9), square (as shown in FIG. 10), oval or horseshoe (as shown in FIG. 11), so as to meet the channel requirements adapted in different underwater working conditions.

In addition, the floating section 11 is formed by splicing several tube bodies 1. The length of the tube body 1 between the two shore foundations 101 is 50-3000 m, preferably 100-2000 m. The floating section 11 is provided with an anchoring device which can be anchored on the riverbed or seabed, or the floating section 11 is connected with a pontoon device which can float on the water surface.

This floating tunnel structure can significantly increase the horizontal stiffness and vertical stiffness of the whole floating tunnel tube body 1 by setting the above-mentioned shore connecting system at both ends of the floating section 11 of the tube body 1, in which the joint section 12 directly passes through the shore foundation 101, and then provides axial tension to the joint section 12 by means of the tension device 2 on the joint section 12, thus playing an additional constraint role on the movement of the tube body 1 and improving the natural vibration frequency of the floating tunnel tube body 1. It can avoid the high-energy area of the sea wave spectrum, reduce the deflection and acceleration of the floating tunnel tube body 1, and at the same time, because the design redundancy is increased, the safety and reliability of the floating tunnel are improved. Due to the increase of axial tension, the tube body 1 of the floating tunnel becomes a structural system with high frequency self-vibration, such as a "string". Through faster vibration, combined with the water around the tube body 1, the damping effect can be effectively achieved, so that when the floating tunnel is moved by waves and water currents in all directions, the high frequency vibration of the tube body 1 can make the energy consumption faster. This feature means that the total kinetic energy consumption of the structure for the anchor-pull floating tunnel can be more concentrated on the tube body 1, which can effectively reduce the stress variation on the cable 22 anchored on the seabed or the riverbed, which is beneficial to the long-term use of the cable 22 and the foundation anchored on the seabed or the riverbed. The construction risk is also lower, and the cost is also lower, which effectively saves the construction cost, effectively reduces the difficulty of maintenance, and is easy to implement and popularize the project.

Embodiment 4

Figure 8:
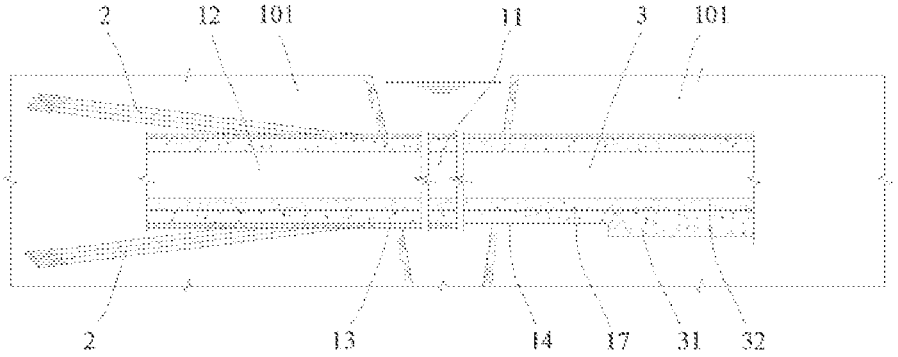
FIG. 8 is a schematic diagram of the second structure of the floating tunnel according to the present invention.

As shown in FIG. 8, this embodiment 4 provides a floating tunnel, which includes a tube body 1 and a hollow cavity 18. The tube body 1 includes a floating section 11, one end of which is connected to the shore connecting system as described above, and the other end is connected to a pull-stop section 3 fixed on the shore foundation 101. The pull-stop section 3 includes a radial protrusion 31 arranged at the end of the floating section 11, and the shore foundation 101 is provided with a groove portion 32 matched with the protrusion 31. The protrusion 31 is a structural member integrally formed with the floating section 11. The protrusion 31 and the groove portion 32 cooperate with each other to provide larger shear force, so that the radial protrusion 31 at the end of the floating section 11 can be fixed relative to the shore foundation 101.

The of the floating tunnel shore connecting system, used as the active end, can provide axial tension. In order to reduce the friction as much as possible, the joint section 12 of the shore connecting system and the shore foundation 101 are connected with low friction to reduce the axial tension loss, so as to ensure the smooth work of the floating tunnel, the pull-stop section 3 used as the passive end only provides the reaction force, and at the same time, it can provide a larger friction force relative to the shore foundation 101 to keep the pull-stop section 3 and the shore foundation 101 relatively fixed.

Embodiment 5

Embodiment 5 also provides a floating tunnel. When one end of the floating section 11 is provided with a shore connecting system, and the other end is connected with a pull-stop section 3 fixed on the shore foundation 101, the difference from Embodiment 4 is that the pull-stop section 3 is a gravity caisson structure connected to the end of the floating section 11. The gravity caisson structure is a steel or reinforced concrete caisson structure. The weight of the pull-stop section 3 at the other end of the floating section 11 is larger than that of other parts, so that the pull-stop section 3 of the floating section 11 can be fixed relative to the shore foundation 101.

Embodiment 6

Embodiment 6 also provides a floating tunnel. When one end of the floating section 11 is provided with a shore connection system, and the other end is provided with a pull-stop section 3 fixed on the shore foundation 101, the pull-stop section 3 is anti-pull anchor connected to the end of the floating section 11, and all the anti-pull anchor are anchored on the shore foundation 101, so that the pull-stop section 3 of the floating section 11 can be fixed relative to the shore foundation 101.

Embodiment 7

Embodiment 7 provides a construction method of a floating tunnel, which includes the following construction steps:

Step 1, manufacturing a floating section 11 and two joint sections 12 of a floating tunnel, wherein the floating section 11 comprises several tube bodies 1 units;

Step 2, constructing the two through holes of the shore foundations 101 used to match the joint section 12 of the floating tunnel;

Step 3, respectively passing the two joint sections 12 through the through holes of the shore foundation 101, and connecting them to the shore foundation 101 through the tension device 2;

Step 4, connecting the two ends of the floating section 11 with the two joint sections 12, respectively, to form the floating tunnel tube body 1;

Step 5, installing an anchoring device which can be anchored on the riverbed or seabed on the floating section 11, or connecting a pontoon device which can float on the water surface to the floating section 11;

Step 6. apply axial tension to the tension devices 2 on the two joint sections 12, and apply tension to the anchoring device, after adjusting each tension to meet the stress requirements, finally complete the construction of the floating tunnel as shown in FIG. 3.

The construction method of the floating tunnel according to the present invention: by firstly connecting two joint sections 12 to the shore foundation 101 by using the tension devices 2 respectively, then splicing them in sections to form the floating section 11, finally connecting the floating section 11 to the two joint sections 12 respectively, and then adjusting the axial tension of the two tension devices 2 on the tube body 1 to finally form the floating tunnel; the construction method is simple to operate, can effectively reduce the stress variation of the cable 22 anchored on the seabed or riverbed, is beneficial to the long-term use of the cable 22 and the foundation anchored on the seabed or riverbed. The construction risk is lower and the cost is lower. It effectively saves the construction cost, effectively reduces the maintenance difficulty, and is easy to implement and popularize the project.

Embodiment 8

Embodiment 8 also provides a floating tunnel, which applies axial tension along one end of the tube body 1, while the other end only provides counterforce. As shown in FIG. 8, the construction method of this floating tunnel includes the following construction steps:

Step 1, manufacturing the floating section 11, the joint section 12 and the pull-stop section 3 of the floating tunnel;

Step 2, constructing a through hole of the shore foundation 101 for matching the joint section 12 of the floating tunnel;

Step 3, passing the joint section 12 through the through hole of the shore foundation 101, and connecting to the shore foundation 101 through the tension device 2;

Step 4, construction is used to cooperate with the floating tunnel stop section 3, and the stop section 3 is installed on the shore foundation 101;

Step 5, connecting the two ends of the floating section 11 to the joint section 12 and the tension stop section 3, respectively, to form the floating tunnel tube body 1;

Step 6, install an anchoring device which can anchor on the riverbed or seabed on the floating section 11, or connect a pontoon device which can float on the water surface on the floating section 11;

Step 7, apply axial tension to the tension device 2 on the joint section 12, and apply tension to the anchoring device, after adjusting each tension to meet the stress requirements, finally complete the construction of the floating tunnel as shown in FIG. 5.

The construction method of the floating tunnel, by manufacturing the floating section 11 of the floating tunnel, a joint section 12 and a pull-stop section 3, by firstly connecting a joint section 12 to the shore foundation 101 by using a tension device 2, and at the same time connect the pull-stop section 3 to the shore foundation 101. Then, after splicing them in sections to form the floating section 11, the floating section 11 connects the joint section 12 and the pull-stop section 3 respectively to form the whole floating tunnel tube body 1. The construction method is simple to operate, can effectively reduce the stress variation of the cable 22 anchored on the seabed or riverbed, is beneficial to the long-term use of the cable 22 and the foundation anchored on the seabed or riverbed. The construction risk is lower and the cost is lower. It effectively saves the construction cost, effectively reduces the maintenance difficulty, and is easy to implement and popularize the project.

The above embodiments are only used to illustrate the present invention, but not to limit the technical solutions described by the present invention. Although the present specification has described the present invention in detail with reference to the above embodiments, the present invention is not limited to the above specific embodiments. Therefore, any modification or equivalent replacement of the present invention is required; all technical solutions and improvements that do not depart from the spirit and scope of the invention should be covered in the scope of the claims of the present invention.

The invention claimed is:

1. A floating tunnel shore connecting system, characterized in that it includes a joint section located at an end of a floating tunnel, which can move axially along a tube body; the joint section is provided with a tension device, which is used to apply axial tension to the joint section;

wherein the tube body is an integral structural member in a linear shape;

the tension device is connected to the joint section, and another end is connected to a shore foundation or a fixed structure;

the floating tunnel can be adopted to apply several oblique forces at each end, and a resultant force of all the oblique forces along an axial component of the floating tunnel is an axial tensile force applied to the end of the floating tunnel;

stress points corresponding to each oblique force applied to each end of the floating tunnel tube body are respectively arranged at different positions along a surface length direction of the tube body; and a size of the axial tension can be adjusted, so that adjustment of the axial tension can adjust a natural vibration frequency of the tube body;

the tension device comprises a plurality of cables arranged on a periphery, one end of all the cables is arranged along the periphery of the floating tunnel joint section, and another end is anchored on the shore foundation or the fixed structure;

each cable of the tension device is provided with a tension adjusting mechanism;

the tension adjusting mechanism on each of the cables includes an anchor chamber at the end of the cable, and the anchor chamber is provided with an adjuster which can adjust a tension of a corresponding one of the cables, and when the anchor chamber is a shore anchor chamber, the shore anchor chamber is arranged on the shore foundation; and by adjusting the tension of each cable to adjust the axial tension applied to joint section, the natural vibration frequency of the tube body of the floating tunnel is adjusted.

2. A floating tunnel shore connecting system according to claim 1, characterized in that the joint section passes through the shore foundation and can move axially relative to the shore foundation.

3. A floating tunnel shore connecting system according to claim 2, characterized in that all the cables are arranged along the surface length direction of the joint section of the floating tunnel; and all the cables arranged along a same section of the joint section of the floating tunnel have a same included angle with an axis of the floating tunnel and are symmetrically arranged.

4. A floating tunnel shore connecting system according to claim 1, characterized in that all the cables are all obliquely connected to the joint section of the floating tunnel, and the included angle $\alpha$ between each cable and the axis of the floating tunnel is less than 30°.

5. A floating tunnel shore connecting system according to claim 1, characterized in that each joint section is provided with several mooring lugs for connecting the cables.

6. A floating tunnel shore connecting system according to claim 1, characterized in that the end of the cable is anchored in a precast concrete block located in the shore foundation or in a steel structure located on the shore ground.

7. A floating tunnel shore connecting system according to claim 5, characterized in that each of the joint sections comprises an annular steel plate layer and a hollow cavity arranged in the annular steel plate layer, and all the mooring lugs are connected to the steel plate layer.

8. The floating tunnel shore connecting system according to claim 7, characterized in that the steel plate layer is internally provided with a ring-shaped reinforced concrete layer; the reinforced concrete layer is internally provided with a plurality of shear members with one end connected to the steel plate layer; and a ring-shaped rubber layer is further arranged between the steel plate layer and the reinforced concrete layer.

9. The floating tunnel shore connecting system according to claim 8, characterized in that a circumferential water-stop member is further arranged between each joint section and the shore foundation, and the circumferential water-stop member is sleeved on the joint section; and the circumferential water-stop member is an elastic structure.

10. A floating tunnel, comprising a tube body, wherein the tube body has a hollow cavity, and the tube body comprises a floating section, and both ends of the floating section are respectively connected with the shore connecting system according to claim 1.

11. A floating tunnel according to claim 10, characterized in that the axial tension applied by two tension devices on two shore connecting systems has a same size and opposite directions.

12. A floating tunnel according to claim 10, characterized in that the floating section and two joint sections each include a steel plate layer and a reinforced concrete layer located in the steel plate layer, all the steel plate layers are integral structural members, and all the reinforced concrete layers are integral structural members;

a cross-sectional shape of the tube body is circular, square, elliptical or horseshoe-shaped; and the floating section comprises several tube units spliced together.

13. A floating tunnel according to claim 12, characterized in that a length of the tube body between two shore foundations is 50-3000 m.

14. A floating tunnel according to claim 13, characterized in that the length of the tube body between the two shore foundations is 200-2000 m.

15. A floating tunnel according to claim 12, characterized in that the floating section is provided with an anchoring device which can be anchored on a riverbed or a seabed, or the floating section is connected with a pontoon device which can float on a water surface.

16. A floating tunnel, comprising the shore connecting system as claimed in claim 1 and the tube body, wherein the tube body has a hollow cavity and includes a floating section, one end of which is connected to the shore connecting system and another end of which is connected to a pull-stop section fixed on the shore foundation.

17. A floating tunnel according to claim 16, characterized in that the pull-stop section includes a radial protrusion arranged at the other end of the floating section, the shore foundation is provided with a groove portion matched with the protrusion, and the protrusion is a structural member integrally formed with the floating section.

18. A floating tunnel according to claim 16, characterized in that the pull-stop section is a gravity caisson structure connected to the other end of the floating section; and the gravity caisson structure is a steel or reinforced concrete caisson structure.

19. A floating tunnel according to claim 16, characterized in that the pull-stop section is an anti-pull anchor connected to the other end of the floating section, and the anti-pull anchor is anchored on the shore foundation.

20. A floating tunnel according to claim 16, characterized in that the floating section and the joint sections each comprise a steel plate layer and a reinforced concrete layer in the steel plate layer, all the steel plate layers are integral structural members, and all the reinforced concrete layers are integral structural members;

a cross-sectional shape of the tube body is circular, square, elliptical or horseshoe-shaped; and the floating section is formed by splicing several tube units.

21. A floating tunnel according to claim 16, characterized in that a length of the tube body between two shore foundations is 50-3000 m.

22. A floating tunnel according to claim 21, characterized in that the length of the tube body between the two shore foundations is 200-2000 m.

23. A floating tunnel according to claim 16, characterized in that the floating section is provided with an anchoring device which can be anchored on a riverbed or a seabed, or the floating section is connected with a pontoon device which can float on a water surface.

24. A construction method for constructing the floating tunnel of claim 10, including the following steps:

Step 1, manufacturing a floating section and two joint sections of a floating tunnel;

Step 2, constructing two through holes of the shore foundation used to match the joint section of the floating tunnel;

Step 3, respectively passing the two joint sections through the through holes of the shore foundation, and connecting them to the shore foundation through the tension device;

Step 4, connecting the two ends of the floating section with the two joint sections, respectively, to form the floating tunnel tube body;

Step 5, installing an anchoring device which can be anchored on the riverbed or seabed on the floating section, or connecting a pontoon device which can float on the water surface to the floating section;

Step 6, applying axial tension to the tension devices on the two joint sections, and applying tension to the anchoring device, after adjusting each tension to meet the stress requirements, finally complete the construction of the floating tunnel.

25. A construction method for constructing the floating tunnel of claim 16, including the following steps:

Step 1, manufacturing the floating section, the joint section, and the pull-stop section of the floating tunnel;

Step 2, constructing a through hole of the shore foundation for matching the joint section of the floating tunnel;

Step 3, passing the joint section through the through hole of the shore foundation, and connecting to the shore foundation through the tension device;

Step 4, construction is used to cooperate with the floating tunnel pull-stop section, and installing the pull-stop section on the shore foundation;

Step 5, connecting the ends of the floating section to the joint section and the pull-stop section, respectively, to form the floating tunnel tube body;

Step 6, installing an anchoring device which can anchor on a riverbed or a seabed on the floating section, or connecting a pontoon device which can float on a water surface on the floating section;

Step 7, applying axial tension to the tension device on the joint section, and applying tension to the anchoring device, after adjusting each tension to meet stress requirements, finally completing the construction of the floating tunnel.

* * * * *